US009587509B2

(12) United States Patent
Guemmer

(10) Patent No.: US 9,587,509 B2
(45) Date of Patent: Mar. 7, 2017

(54) ASSEMBLY FOR A FLUID FLOW MACHINE

(71) Applicant: Rolls-Royce Deutschland Ltd & Co KG, Blankenfelde-Mahlow (DE)

(72) Inventor: Volker Guemmer, Mahlow (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 387 days.

(21) Appl. No.: 14/289,318

(22) Filed: May 28, 2014

(65) Prior Publication Data

US 2014/0363277 A1 Dec. 11, 2014

(30) Foreign Application Priority Data

May 31, 2013 (DE) ..... 10 2013 210 171

(51) Int. Cl.
*F04D 29/68* (2006.01)
*F01D 17/10* (2006.01)
(Continued)

(52) U.S. Cl.
CPC ..... *F01D 17/105* (2013.01); *F04D 29/526* (2013.01); *F04D 29/541* (2013.01);
(Continued)

(58) Field of Classification Search
CPC .... F01D 17/105; F04D 29/541; F04D 29/681; F04D 29/682; F04D 29/684;
(Continued)

(56) References Cited

U.S. PATENT DOCUMENTS 3,462,071 A 8/1969 Garve
5,586,859 A 12/1996 Nolcheff
(Continued)

FOREIGN PATENT DOCUMENTS

BE 680460 10/1966
DE 69616435 1/1997
(Continued)

OTHER PUBLICATIONS

European Search Report dated Nov. 3, 2014 for counterpart European Patent Application No. 14170065.8.

*Primary Examiner* — John K Fristoe, Jr.
*Assistant Examiner* — Sabbir Hasan
(74) *Attorney, Agent, or Firm* — Shuttleworth & Ingersoll, PLC; Timothy J. Klima

(57) ABSTRACT

A structural assembly for a fluid-flow machine includes a main flow path boundary, a row of relatively rotating blades with a gap existing between the blade ends and the main flow path boundary. A secondary flow duct is connected to the main flow path via the two openings spaced apart in the flow direction. A structural assembly has at least one support component and at least one replaceable plug connected directly or indirectly to the support component. The replaceable plug includes a part-section of a secondary flow duct, where the part-section complements at least one further part-section of the secondary flow duct extending outside the plug in the structural assembly to form a secondary flow duct which is continuous between its openings.

22 Claims, 8 Drawing Sheets

(51) Int. Cl.
*F04D 29/52* (2006.01)
*F04D 29/54* (2006.01)

(52) U.S. Cl.
CPC ..... *F04D 29/681* (2013.01); *F04D 29/685* (2013.01); *F05D 2260/15* (2013.01); *F05D 2260/606* (2013.01); *F05D 2270/17* (2013.01)

(58) Field of Classification Search
CPC .. F04D 29/685; F04D 29/526; F05D 2270/17; F05D 2260/606
USPC ..... 415/57.1, 57.3, 57.4, 58.5, 58.7
See application file for complete search history.

(56) References Cited

U.S. PATENT DOCUMENTS

| | | | | |
|---|---|---|---|---|
| 5,950,308 | A * | 9/1999 | Koff | F01D 5/145 29/889 |
| 6,585,479 | B2 | 7/2003 | Torrance | |
| 6,726,441 | B2 | 4/2004 | Sumser et al. | |
| 6,742,983 | B2 | 6/2004 | Schmuecker | |
| 7,967,556 | B2 | 6/2011 | Guemmer | |
| 8,152,445 | B2 | 4/2012 | Guemmer | |
| 8,262,340 | B2 | 9/2012 | Guemmer | |
| 8,382,422 | B2 | 2/2013 | Guemmer | |
| 2005/0226717 | A1 | 10/2005 | Xu | |
| 2012/0201654 | A1 * | 8/2012 | Bouru | F04D 27/0207 415/116 |

FOREIGN PATENT DOCUMENTS

| | | |
|---|---|---|
| DE | 10105456 | 8/2002 |
| DE | 10135003 | 10/2002 |
| DE | 10330084 | 3/2004 |
| DE | 102004030597 | 1/2006 |
| DE | 102008037154 | 2/2010 |
| EP | 0497574 | 8/1992 |
| EP | 0754864 | 1/1997 |
| EP | 1659293 | 5/2006 |
| EP | 2108784 | 10/2014 |

* cited by examiner

ASSEMBLY FOR A FLUID FLOW MACHINE

BACKGROUND

This application claims priority to German Patent Application No. 10 2013 210 171.6 filed on May 31, 2013, the entirety of which is incorporated by reference herein.

This invention relates to a structural assembly for a fluid-flow machine.

The aerodynamic loadability and the efficiency of fluid-flow machines, in particular of fluid-flow machines such as blowers, compressors, pumps and fans, is limited by the growth and the separation of boundary layers in the rotor and stator blade tip area near the casing or the hub wall, respectively. On blade rows with running gap, this leads to high secondary losses and possibly to the occurrence of operational instabilities at higher loads.

A known counter-measure is to use so-called casing treatments. The simplest form of casing treatments are circumferential grooves having rectangular or parallelogram-shaped cross-sections, as disclosed for example in EP 0 754 864 A1. Other solutions provide for rows of slots or openings in the casing, with the individual slots/openings being oriented substantially in the flow direction and having a slender form with a small extent when viewed in the circumferential direction of the machine. Solutions of this kind are disclosed for example in DE 101 35 003 C1.

Further casing treatments include provision of a ring over the entire circumference in the area of a rotor in the casing, with stator vanes often being provided to reduce the flow swirl inside the treated casing, as for example described in the publications EP 0 497 574 A1, US 2005-0226717 A1, U.S. Pat. No. 6,585,479 B2, US 2005-0226717 A1 and DE 103 30 084 A1.

Existing concepts for casing treatments in the form of slots and/or chambers in the annular duct wall offer increased stability of the fluid-flow machine. This is however only achieved with a loss in efficiency due to the unfavourably selected arrangement or shape. Known solutions also take up a large installation space at the periphery of the annular duct of the fluid-flow machine, and due to their shape (e.g. simple parallelogram-shaped circumferential casing grooves) they are only of restricted effectiveness and are always provided in the casing in the area of a rotor blade row. Casing treatments according to the state of the art are intended for easy implementation in the casing from an accessible side with the aid of machining, usually metal-cutting.

The use of injector systems is known as a further counter-measure against secondary losses and the occurrence of operational instabilities. For example, it is known from U.S. Pat. No. 8,152,445 B2, to pass fluid from a fluid supply chamber into the flow duct by means of a nozzle system. FIG. 1 shows the solution described in U.S. Pat. No. 8,152,445 B2. A disadvantage of this solution is that a complex secondary flow duct system for fluid injection in the area of the casing or hub must be provided by specific design and production measures.

A fluid-flow machine is known from DE 10 2008 037 154 A1, which has, in the area of the blade leading edge in a main flow path boundary, at least one secondary flow duct connecting to one another two openings arranged on the main flow path boundary. Each secondary flow duct connects one discharge opening to a supply opening provided further upstream. The provision of secondary flow ducts of this type permits effective influencing of the boundary layer in the blade tip area and hence allows an increase in the stability of a fluid-flow machine, without the need for an expensive casing treatment over the entire casing circumference in the area of a rotor. However, complex secondary flow ducts in the area of the casing or hub can only be achieved by specific design and production measures.

SUMMARY

Based on DE 10 2008 037 154 A1, an object underlying the present invention is to provide a structural assembly that can efficiently provide secondary flow ducts, even those of complex shape, in the area of a main flow path boundary of a fluid-flow machine (i.e. in the area of the casing or hub).

It is provided in accordance with an embodiment of the invention that the structural assembly has at least one support component and at least one replaceable plug connected directly or indirectly to the support component. The plug is for example connected directly to the support component, e.g. arranged on the circumference of the support component, or it is connected to a component connected to the support component, and hence indirectly to the support component. It is furthermore provided in accordance with the invention that the replaceable plug includes a part-section of a secondary flow duct, said part-section complementing at least one further part-section of the secondary flow duct extending outside the plug in the structural assembly to form a secondary flow duct which is continuous between its openings.

The solution in accordance with the invention has the advantage that the secondary flow duct can be interrupted or varied by replacing the plug. A part-section of the secondary flow duct provided in the plug can also be replaced in a simple manner in the event of wear. Spatially compact and sturdy three-dimensional structures of a secondary flow duct can be provided in the plug at the same time.

The invention thus considers a section of the main flow path of a fluid-flow machine, in the area of a blade row with free end and running gap, in which a row of secondary flow ducts distributed in the circumferential direction is provided. The course of the secondary flow ducts can be spatially complex in each case. In accordance with the invention, a structural assembly is provided for structural implementation of said secondary flow ducts.

In an embodiment of the invention, it is provided that the replaceable plug passes through at least one structural component which forms the boundary of the main flow path and which is the support component or a further component.

In a further embodiment of the invention, it is provided that the support component forms with at least some of its faces at least part of the main flow path boundary. It can also be provided that the replaceable plug extends in a substantially radial direction relative to the main flow path and forms a front face which forms part of the main flow path boundary. According to a design variant, at least one of the openings of the secondary flow duct is provided in the front face of the replaceable plug.

According to an embodiment of the invention, at least one part-section of a secondary flow duct is formed inside the support component, so that at least the support component and the plug contain part-sections of the secondary flow duct. Further part-sections can be provided by further components.

According to an embodiment of the invention, the support component is designed as an annular casing or as a half-shell casing of a fluid-flow machine, or the support component is designed annular or semi-annular on the hub of a fluid-flow machine.

In an advantageous design variant, the support component is designed such that for the purposes of fitting and removing of the replaceable plug, direct access to the replaceable plug is possible from the side facing away from the main flow path, so that the replaceable plug can be replaced from that side of the support component facing away from the main flow path without dismantling other structural components.

In a further design variant, the structural assembly in accordance with the invention furthermore includes at least one insertion component, where a recess extending in the circumferential direction is provided in the support component and receives along the circumference at least one insertion component, and where each insertion component forms with some of its faces part of the main flow path boundary and provides at least one part-section of a secondary flow duct.

It can be provided here that the insertion component is passed through completely at the circumference by at least one replaceable plug, such that the front face of the replaceable plug forms part of the main flow path boundary. It can also be provided that the replaceable plug only passes through the insertion component and has a defined seat there, with the support component having a local recess through which the replaceable plug in the insertion component can be fitted and removed. Alternatively, the replaceable plug passes through both the support component and the insertion component.

According to an embodiment of the invention, the structural assembly in accordance with the invention furthermore includes at least one connecting component, where the connecting component adjoins the support component substantially on that side of the support component facing away from the main flow path and where the connecting component provides at least one part-section of a secondary flow duct.

It can be provided that the support component is passed through completely at the circumference by at least one replaceable plug, such that the front face of the replaceable plug forms part of the main flow path boundary, with part-sections of a secondary flow duct being provided in the support component, in the connecting component and in the replaceable plug and complementing each other to form one continuous secondary flow duct.

A further variant of the invention provides that the connecting component is installed in the area of at least one end of the secondary flow duct into recesses in the support component and in this way directly adjoins the main flow path. With this design variant, the connecting component thus also provides an area of the secondary flow duct close to the opening.

For receiving and fastening of the replaceable plug, at least one connector can be provided on the circumference of the support component on that side of the support component facing away from the main flow path. Also, at least one web for receiving at least one replaceable plug and running continuously along at least part of the circumference can be provided on that side of the support component facing away from the main flow path.

A further variant of the invention provides that the replaceable plug is designed as a multi-part element. In this connection, a design variant provides that the replaceable plug is split along at least part-sections of the secondary flow duct into part-plugs. To do so, a further design variant provides that the replaceable plug is designed in two parts and includes a fixing upper plug and a lower plug provided for example with a defined seat, with the upper and lower plugs jointly forming the replaceable plug.

According to a design variant, fixing of the replaceable plug is achieved by a snug fit, press fit, plug-in connection, clamped connection or a bolted connection.

The replaceable plug with implemented part-section of a secondary flow duct can, in order to prevent a flow through the secondary flow duct, be replaced by a blank plug without implemented duct.

The present invention generally relates to structural assemblies for fluid-flow machines, such as turbines, and in particular to fluid-flow machines such as blowers, compressors, pumps and fans of the axial, semi-axial and radial type. The working medium may be gaseous or liquid. The fluid-flow machine may include one or several stages, each having a rotor and a stator. In individual cases, the stage is formed only by a rotor.

The rotor of a fluid-flow machine, in which a structural assembly in accordance with the present invention is used, includes a number of blades, which are connected to the rotating shaft of the fluid-flow machine and impart energy to the working medium. The rotor may be provided with or without shroud at the outer blade end.

The stator of a fluid-flow machine, in which a structural assembly in accordance with the present invention is used, includes a number of stationary vanes, which may have a fixed or a free vane end both on the hub and on the casing side.

The rotor drum and the blading are usually enclosed by a casing. In other cases, e.g. in the case of aircraft or ship propellers, no such casing exists.

A fluid-flow machine, in which a structural assembly in accordance with the present invention is used, may also feature a stator, a so-called inlet guide vane assembly, upstream of the first rotor. Departing from a stationary fixation, at least one stator or inlet guide vane assembly may be rotatably borne, to change the angle of attack. Variation is accomplished for example via a spindle accessible from the outside of the annular duct.

In an embodiment, a fluid-flow machine, in which a structural assembly in accordance with the present invention is used, may include at least one row of variable rotors.

In an embodiment, a fluid-flow machine, in which a structural assembly in accordance with the present invention is used, may have two counter-rotating shafts, in the event of a multi-stage design, with the direction of rotation of the rotor blade rows alternating between stages. Here, no stators exist between subsequent rotors.

In an embodiment, a fluid-flow machine, in which a structural assembly in accordance with the present invention is used, may feature a bypass configuration such that a single-flow annular duct divides into two concentric annular ducts behind a certain blade row, with each of these annular ducts containing at least one further blade row.

The fluid-flow machine, in which a structural assembly in accordance with the present invention is used, is for example a jet engine, in particular a turbofan engine. The structural assembly is for example provided in the area of a compressor of a jet engine or turbofan engine.

The present invention furthermore relates to a fluid-flow machine having a structural assembly in accordance with the present invention.

BRIEF DESCRIPTION OF THE DRAWINGS

The present invention is described in the following with reference to the figures of the accompanying drawing, showing several exemplary embodiments.

DETAILED DESCRIPTION

Figure 1:
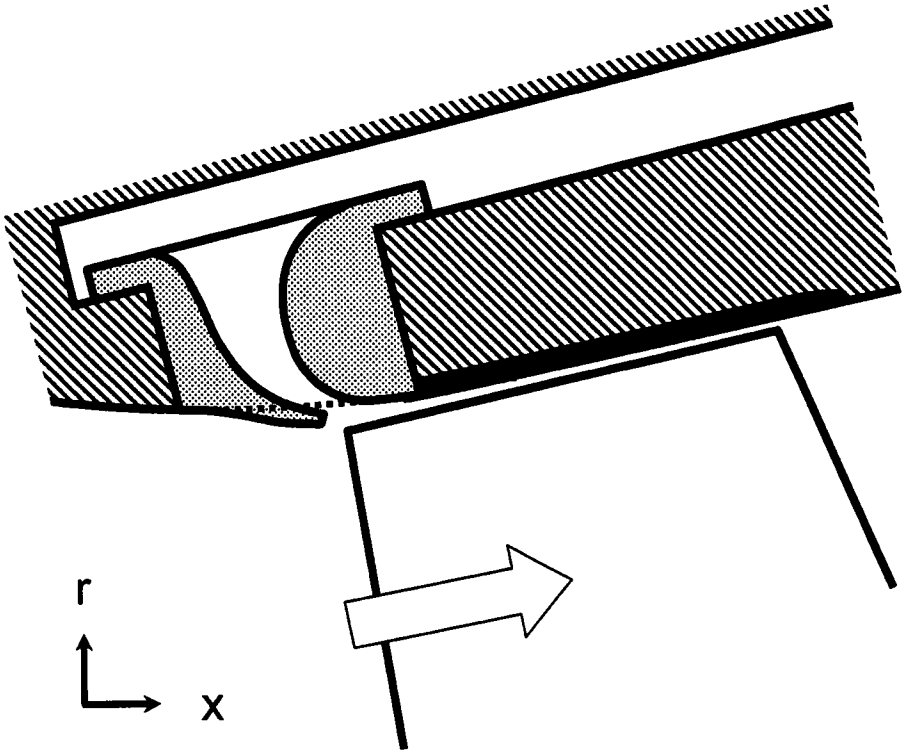
FIG. 1 shows a rotor casing with an integrated nozzle for injecting fluid into a running gap in accordance with the state of the art.

The teachings in accordance with the state of the art for injection of fluid from a fluid supply chamber into a flow duct by means of a nozzle system were described at the outset on the basis of FIG. 1.

Figure 2A:
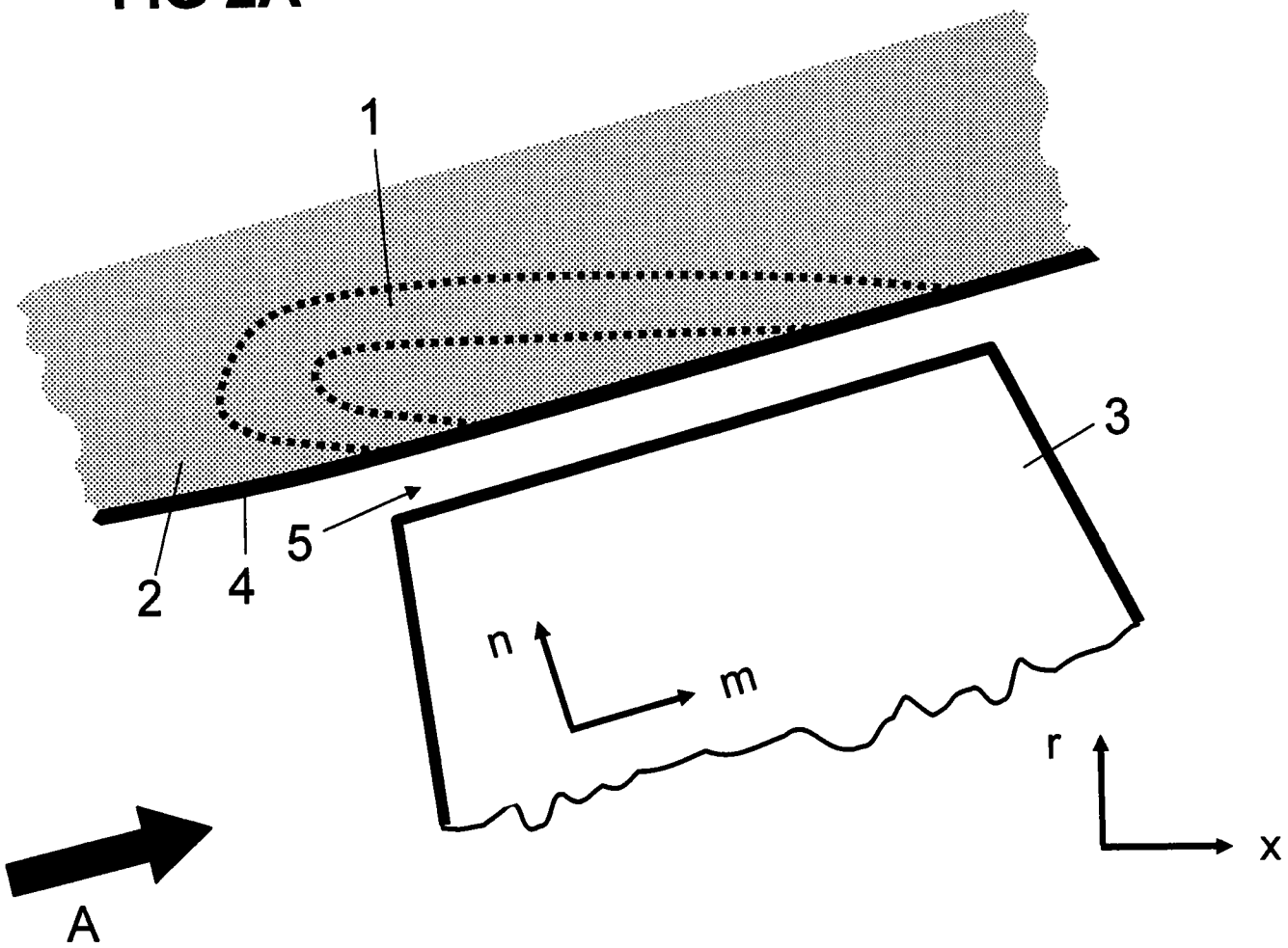
FIG. 2A shows, in meridional sectional view, an exemplary embodiment of a rotor casing of a fluid-flow machine having a secondary flow duct.

FIG. 2A shows an arrangement of a blade row 3 with free end and running gap 5 in the meridional plane established by the axial direction x and the radial direction r. The running gap 5 separates the blade tip from a component 2 associated with the main flow path on the hub or casing of the fluid-flow machine. The component 2 forms here a main flow path boundary 4 towards the main flow path.

There is a rotating relative movement between the blade tip and the component 2 associated with the main flow path. The illustration thus applies equally for the following arrangements:

1) rotating blade on stationary casing,
2) stationary blade on rotating hub,
3) stationary blade on rotating casing, and
4) rotating blade on stationary hub.

The main flow direction in the main flow path is indicated by an arrow A. Further blade rows can be located upstream and/or downstream of the blade row 3 with running gap. Inside the component 2 associated with the main flow path, a row of secondary flow ducts 1 distributed over the circumference is provided in the area of the running gap 5, said ducts having an opening at each of their ends (supply opening and discharge opening).

The openings of the secondary flow ducts are located on the main flow path boundary 4. FIG. 2A shows the outline or projection of a single secondary flow duct 1 in the meridional plane (x-r). Viewed spatially, each duct 1 has a three-dimensional and spatially winding course, shown by way of example in FIG. 2B.

Figure 2B:
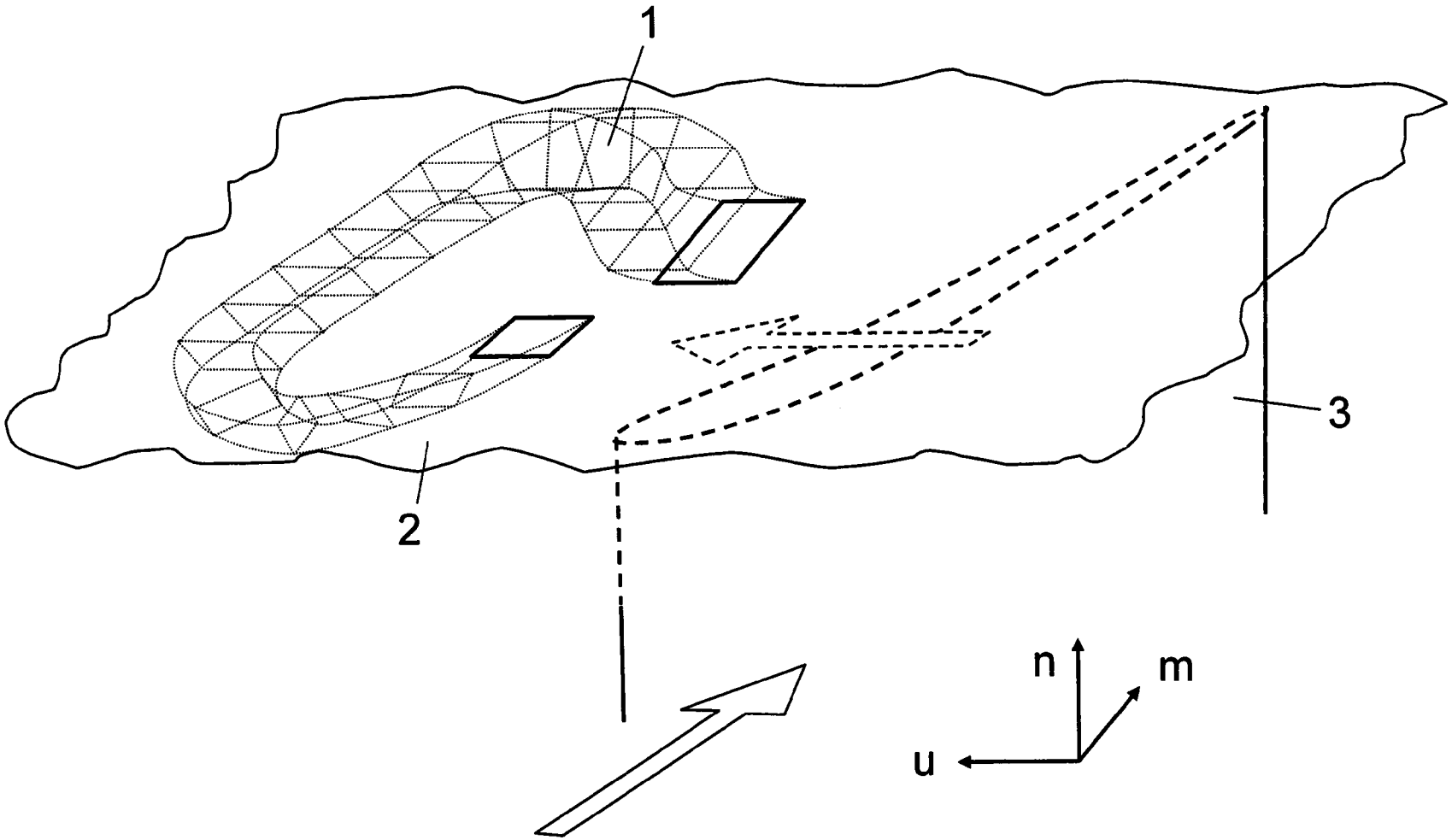
FIG. 2B shows, in a three-dimensional view, an exemplary embodiment of a rotor casing of a fluid-flow machine having a secondary flow duct.

It is pointed out that the cross-sectional shape of the secondary flow ducts 1 in FIG. 2B is illustrated as rectangular only by way of example. The cross-section of the secondary flow ducts 1 in other design variants can for example be designed without corners, in particular circular or elliptical.

Figure 3A:
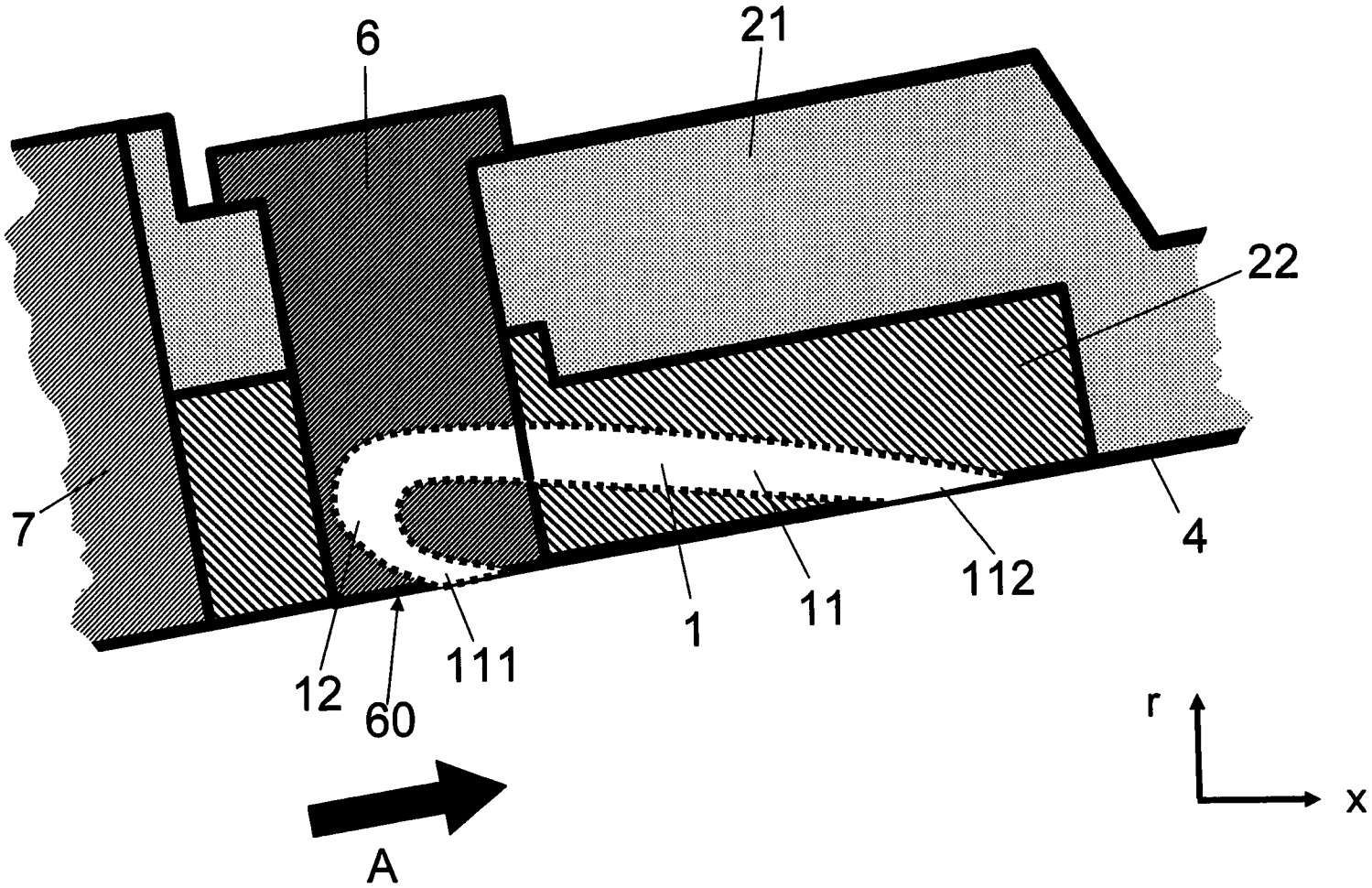
FIG. 3A shows a first exemplary embodiment of a structural assembly for a fluid-flow machine forming a secondary flow duct.

FIG. 3A shows a structural assembly in accordance with the present invention in the area of a blade row with running gap in the meridional view (x-r). The main flow direction is indicated by an arrow A. The blade row is no longer shown here for the sake of a simpler illustration.

In the structural assembly, at least one secondary flow duct 1 is provided which has two openings 111, 112 in the main flow path boundary 4 and is connected via these openings to the main flow path. It is pointed out here that in the exemplary embodiment of FIG. 3A the secondary flow duct 1 is designed as a one-way path, having one opening through which fluid flows out of the main flow duct into the secondary flow duct 1 and a second opening through which fluid exits the secondary flow duct 1. Through which of the openings 111, 112 fluid flows in, and through which of the openings 111, 112 fluid flows out, depends here on the precise positioning of the openings 111, 112 relative to the blades of the blade row 3 (cf. FIG. 2B).

In alternative embodiments, it can be provided that at least one of the secondary flow ducts is formed by an arrangement in which a single duct splits along its course into at least two part-ducts and thereby forms a type of Y-configuration. In this case, an inflow opening and several outflow openings associated with the secondary flow duct are provided. According to a further alternative embodiment, it can be provided that at least one of the secondary flow ducts is formed by an arrangement in which at least two ducts converge into one duct, with several inflow openings and one outflow opening then being associated with the secondary flow duct.

According to FIG. 3A, the secondary flow duct 1 is achieved in a structural assembly including a support component 21, an insertion component 22 and a replaceable plug 6.

The support component 21 is used for structural implementation in the area of the inner or outer main flow path boundary and can be part of the outward casing or of the inward hub of the fluid-flow machine. It can be provided that it forms with some of its faces part of the main flow path boundary 4. In the exemplary embodiment shown, the support component 21 represents a part of the outward casing of the fluid-flow machine. In principle, the support component 21 can in particular be a part of the fluid-flow machine design in the following areas:

- part of a single-shell or multi-shell casing of blade rows or stages with fixed blade geometry,
- part of a single-shell or multi-shell casing of blade rows or stages with variable blade geometry,
- part of rotor drums, rotor disks or blisk modules,
- part of inner shroud assemblies in the hub area of stator vanes.

In the exemplary embodiment of FIG. 3A, the support component 21 is designed as an annular casing of a fluid-flow machine or as a half-shell casing of a fluid-flow machine. With an appropriate arrangement in the hub area, it is for example designed annular on the hub of a fluid-flow machine or semi-annular on the hub of a fluid-flow machine.

A recess extending in the circumferential direction is provided in the support component 21, into which recess at least one insertion component 22 is inserted along the circumference. The insertion component 22 forms here with some of its faces part of the main flow path boundary 4.

The replaceable plug 6 extends, relative to the main flow path, in a substantially radial direction, passing through both the support component 21 and the insertion component 22. The plug 6 has a front face 60 forming a part of the main flow path boundary 4.

The secondary flow duct 1 includes two part-sections 11, 12, where the one part-section 11 is provided in the insertion component 22 and the other part-section 12 in the replaceable plug 6. The part-sections 11, 12, in the insertion component 22 and in the replaceable plug 6, complement each other to form a continuous secondary flow duct 1. One of the two openings 111, 112 of the secondary flow duct 1 is provided in the insertion component 22 and the other of the openings 111, 112 of the secondary flow duct 1 in the plug 6.

It is pointed out that in the exemplary embodiment of FIG. 3A, the insertion component 22 is inserted in the axial direction into the appropriate recess in the support component 21. The components 21, 22 can be fixed relative to one another in the axial direction by a further component 7.

It is furthermore pointed out that the part-section 12 of the secondary flow duct 1 is provided by means of internal faces of the plug 6, i.e. not by means of structures formed on the outside of the plug 6.

The provision of a part-section 12 of the secondary flow duct 1 in a replaceable plug 6 has the advantage that it is possible, by replacing the plug 6 with a blank plug without integrated duct section, to prevent a flow through the secondary flow duct 1. A flow through a secondary flow duct can therefore be switched on and off by means of the replaceable plug 6. It is also possible to keep available various plugs 6 in which the part-section 12 provided in the plug 6 is designed in different ways, where the part-section 11 provided in the insertion component 22 is complemented in different ways in each case. In this way, the design of the secondary flow duct 1 and the flow taking place inside the latter can be varied in simple manner.

Figure 3B:
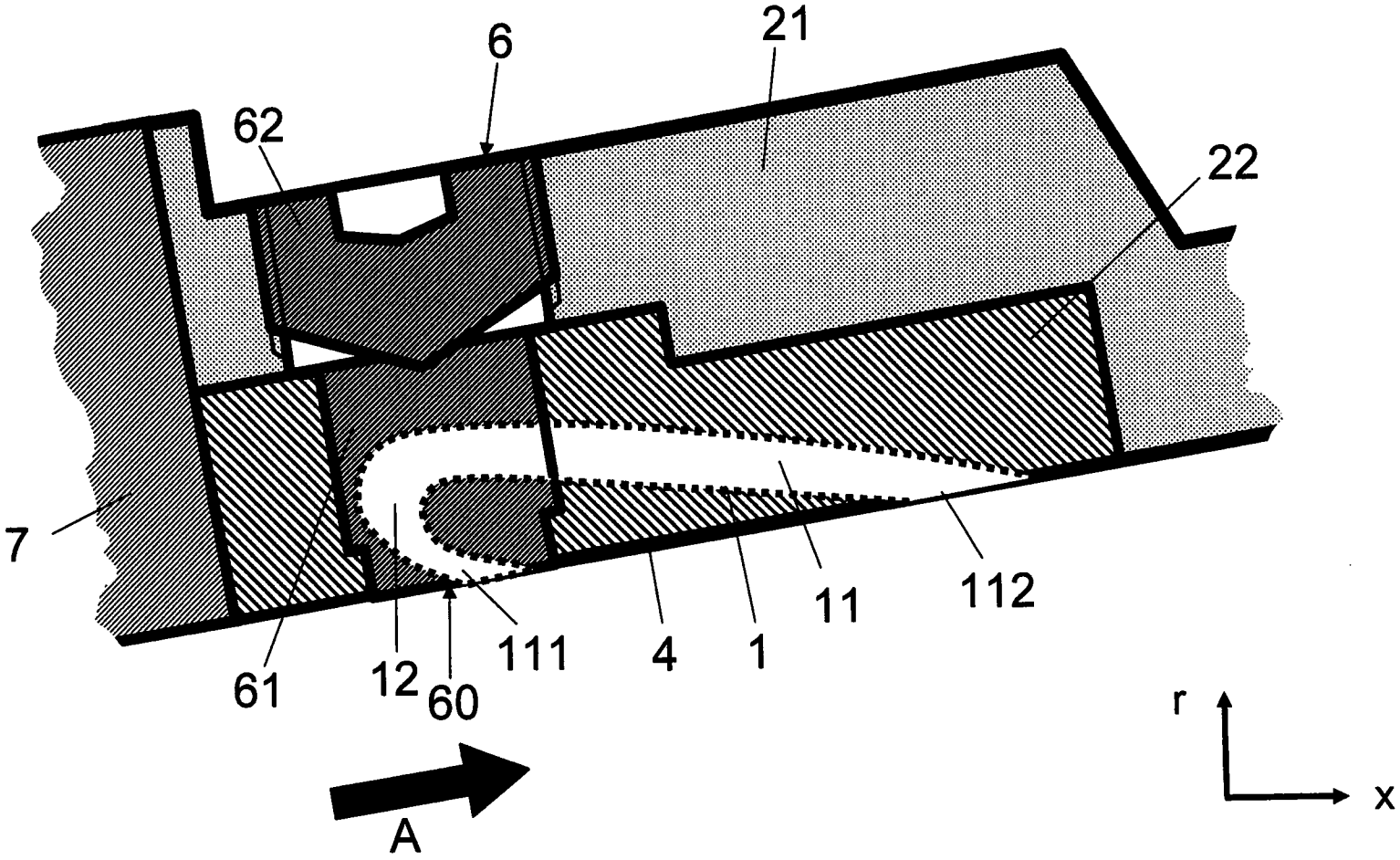
FIG. 3B shows a second exemplary embodiment of a structural assembly for a fluid-flow machine forming a secondary flow duct.

FIG. 3B shows a further exemplary embodiment of a structural assembly in the area of a blade row with running gap in the meridional view (x-r). The exemplary embodiment of FIG. 3B differs from the exemplary embodiment of FIG. 3A in that the replaceable plug 6 is designed as a multi-part element. The plug 6 is thus split into two part-plugs 61, 62, with more than two part-plugs also being possible in principle. According to FIG. 3B, the plug 6 includes a fixing upper plug 62 and a lower plug 61 provided with a good snug fit. The part-section 12 of the secondary flow duct 1 is here provided in the lower plug 61. The upper plug 62 is for example fixed by a bolted connection or the like inside an appropriate opening of the support component 21.

Figure 3C:
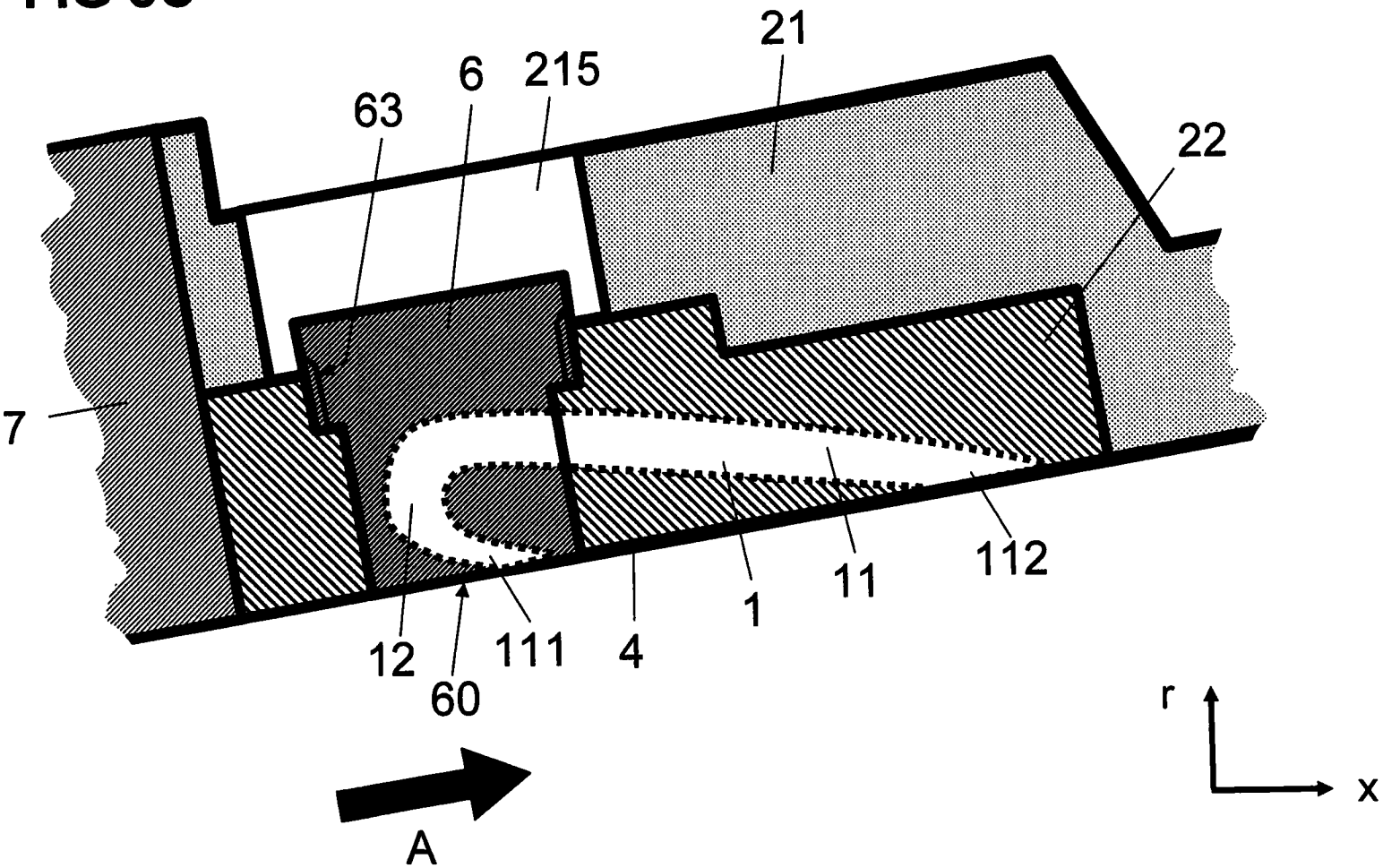
FIG. 3C shows a third exemplary embodiment of a structural assembly for a fluid-flow machine forming a secondary flow duct.

FIG. 3C shows a further exemplary embodiment of a structural assembly in the area of a blade row with running gap in the meridional view (x-r). With this embodiment, it is provided, unlike in the embodiments of FIGS. 3A and 3B, that the replaceable plug 6 passes only through the insertion component 22 and is fitted into the latter. A structural component through which the plug 6 passes is thus provided solely by the insertion component 22.

The support component 21 here possesses a local recess 215, for example in the form of an assembly opening, through which the replaceable plug 6 in the insertion component 22 can be fitted and removed. It can for example be provided that the plug 6 has a round cross-section and is fixed in the insertion component 22 by means of a thread 63 in its upper part. However, the shape and fixing method of the replaceable plug 6 can also differ.

Figure 3D:
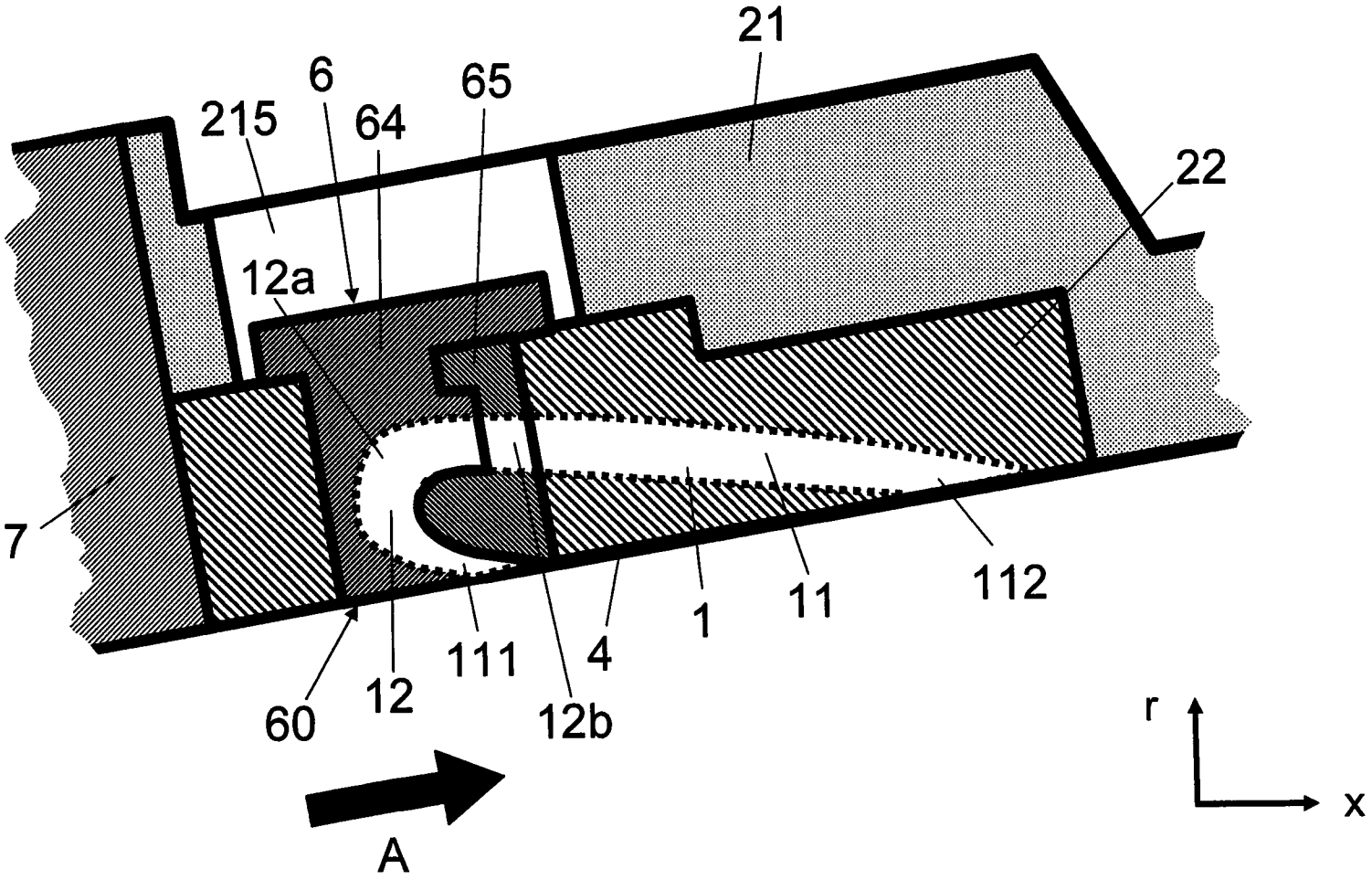
FIG. 3D shows a fourth exemplary embodiment of a structural assembly for a fluid-flow machine forming a secondary flow duct.

FIG. 3D shows a further exemplary embodiment of a structural assembly in the area of a blade row with running gap in the meridional view (x-r). With this exemplary embodiment, the replaceable plug 6 in turn passes solely through the insertion component 22, with an assembly opening 215 being provided above the plug 6 in the support component 21. Unlike in the exemplary embodiment of FIG. 3C, the plug 6 is designed as a multi-part element with two part-plugs 64, 65, with the provision of more than two part-plugs also being possible. The splitting of the plug 6 into two part-plugs 64, 65 is achieved here along two sections of the secondary flow duct 1, i.e. each of the two part-plugs 64, 65 contains a lower part-section 12*a*, 12*b* of the part-section 12 provided in the plug 6. This has the advantage that the secondary flow duct 1 can be made easier to access, for example for a production tool.

Due to the possible complexity of the secondary flow ducts in respect of their three-dimensional shape, it can be provided that the replaceable plug 6 is manufactured by a casting, sintering or printing production method. This applies for all the exemplary embodiments described.

Figure 3E:
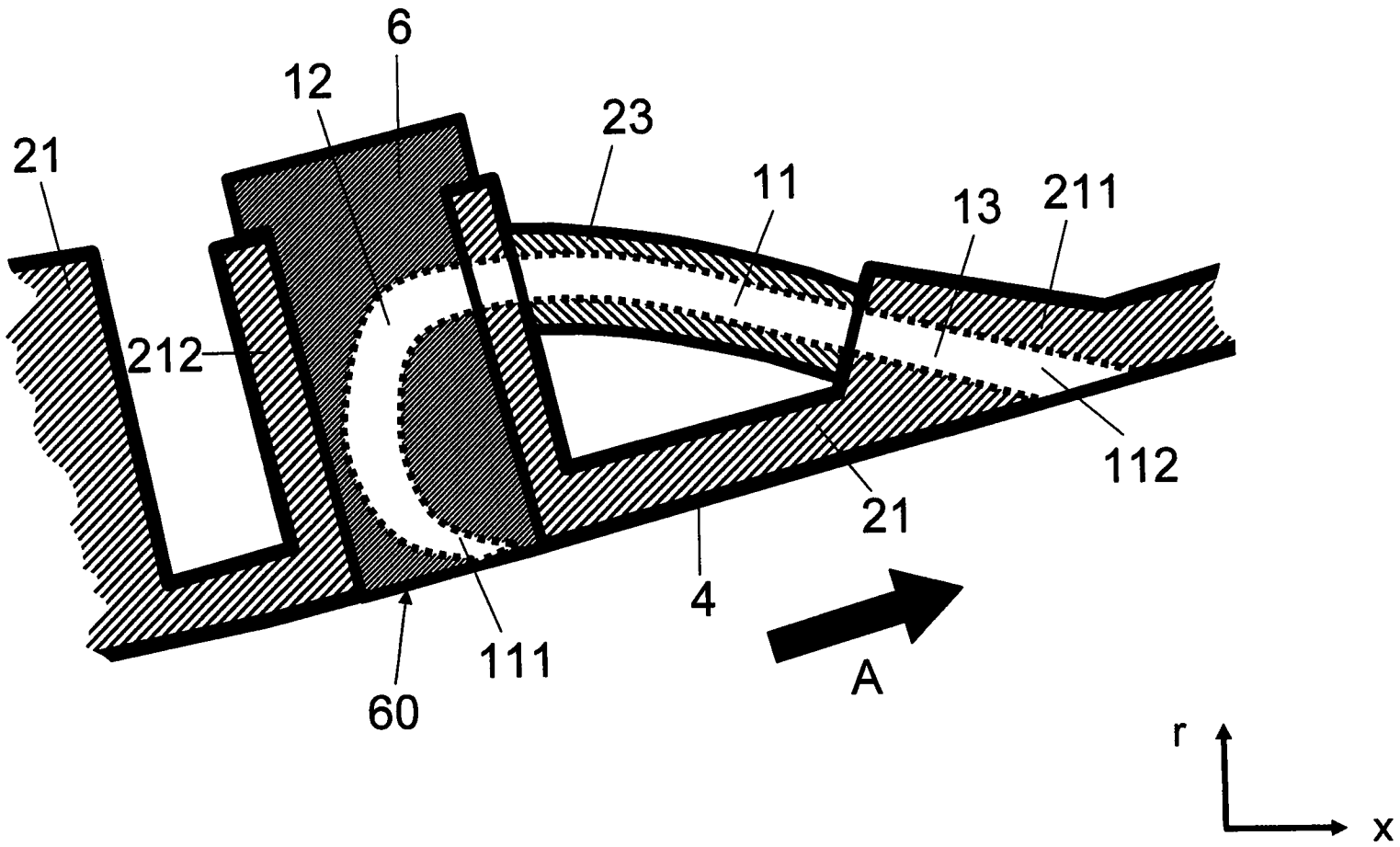
FIG. 3E shows a fifth exemplary embodiment of a structural assembly for a fluid-flow machine forming a secondary flow duct.

FIG. 3E shows a further exemplary embodiment of a structural assembly in the area of a blade row with running gap in the meridional view (x-r). In this exemplary embodiment, the secondary flow duct 1 includes three part-sections 11, 12, 13, with one part-section being incorporated in a support component 21, one part-section in a replaceable plug 6 and one part-section in a connecting component 23.

The support component 21 forms with some of its faces part of the main flow path boundary 4. It forms at the side facing away from the main flow path a structure 212 for receiving the replaceable plug 6, said structure being formed by a cylindrical wall or a connector 212 in the exemplary embodiment shown. The plug 6 is inserted into the wall 212, with the front face 60 of the plug 6 representing part of the main flow path boundary 4. A part-section 12 of the secondary flow duct and one of the openings 111 of the secondary flow duct are integrated in the plug 6.

The support component 21 furthermore has on its side facing away from the main flow path a web 211 in which a first section 13 of the secondary flow duct is provided. Between the web 211 and the connector or the wall 212 is the connecting component 23 that extends between these part-sections 211, 212 of the support component 21 on that side of the support component 21 facing away from the main flow path and is, for example, arranged freely in the space as a pipe.

Fixing of the replaceable plug 6 can be achieved for example by a snug fit, press fit, plug-in connection, clamped connection or a bolted connection. The connecting component 11 is for example fixed to the web 211 and to the connector 212 by a snug fit, plug-in connection, clamped connection, bolted connection or by welding or brazing.

According to an alternative embodiment, the connecting component 23 is designed such that it is inserted in the area of at least one end of the secondary flow duct into recesses in the support component 21 and in this way has faces forming part of the main flow path boundary 4. For example, in a variation of FIG. 3E the connector 211 is designed as part of the connecting component 23.

In further embodiments of the invention, the design solutions described with reference to FIGS. 3A to 3E can be combined with one another. For example, a multi-part plug 6 can also be provided in the exemplary embodiment of FIG. 3E.

The present invention, in its design, is not restricted to the exemplary embodiments presented above, which are only to be understood as examples. The shape and the embodiment of the secondary flow ducts and of the components constituting them (support component, connecting component, insertion component and plug) can for example be designed in a different manner than that shown.

What is claimed is:

1. A structural assembly for a fluid-flow machine comprising:

a main flow path boundary confining a main flow path of a fluid-flow machine, where a row of blades each with one blade end is arranged in the main flow path, where a gap exists between the blade ends of the at least one row of blades and the main flow path boundary, and where there is a rotating relative movement between the blades of the row of blades and the main flow path boundary, a secondary flow duct, having in the main flow path boundary two openings, one opening each at ends spaced apart in a flow direction, such that the secondary flow duct is connected to the main flow path via the two openings, a support component, a replaceable plug connected directly or indirectly to the support component, wherein the replaceable plug includes a part-section of the secondary flow duct, where the part-section complements at least one further part-section of the secondary flow duct extending outside the replaceable plug in the structural assembly such that the secondary flow duct is continuous between the two openings, wherein the support component is configured such that for fitting and removing of the replaceable plug, the replaceable plug is directly accessible from a side facing away from the main flow path, so that the replaceable plug is freely accessible and replaceable from the side of the support component facing away from the main flow path without dismantling other components of the structural assembly.

2. The structural assembly in accordance with claim 1, wherein the main flow path boundary is at least partially formed by a structural component and the replaceable plug passes through the structural component, the structural component including at least one chosen from the support component and an insert component.

3. The structural assembly in accordance with claim 1, wherein a face of the support component forms part of the main flow path boundary.

4. The structural assembly in accordance with claim 1, wherein the replaceable plug extends in a substantially radial direction relative to the main flow path.

5. The structural assembly in accordance with claim 1, wherein the replaceable plug includes a front face which forms part of the main flow path boundary.

6. The structural assembly in accordance with claim 5, wherein at least one of the openings of the secondary flow duct is provided in the front face of the replaceable plug.

7. The structural assembly in accordance with claim 1, wherein a part-section of the secondary flow duct is formed inside the support component.

8. The structural assembly in accordance with claim 1, wherein the support component is an annular casing or a half-shell casing of the fluid-flow machine, or is an annular or semi-annular portion of a hub of the fluid-flow machine.

9. The structural assembly in accordance with claim 1, wherein the assembly furthermore includes an insertion component, and the support component includes a recess extending in the circumferential direction and receiving along the circumference the insertion component, and where faces of the insertion component form part of the main flow path boundary and a part-section of the secondary flow duct.

10. The structural assembly in accordance with claim 9, wherein the insertion component is passed through completely by the replaceable plug, such that a front face of the replaceable plug forms part of the main flow path boundary.

11. The structural assembly in accordance with claim 9, wherein the replaceable plug engages and only passes entirely through the insertion component, with the support component having a local recess through which the replaceable plug can be fitted in and removed from the insertion component.

12. The structural assembly in accordance with claim 9, wherein the replaceable plug passes through both the support component and the insertion component.

13. The structural assembly in accordance with claim 1, wherein the assembly furthermore includes a connecting component, where the connecting component adjoins the support component substantially on a side of the support component facing away from the main flow path and where the connecting component provides at least one part-section of the secondary flow duct.

14. The structural assembly in accordance with claim 13, wherein the support component is passed through completely by the replaceable plug, such that a front face of the replaceable plug forms part of the main flow path boundary, with part-sections of a secondary flow duct being provided in the support component, in the connecting component and in the replaceable plug and complementing each other to form one continuous secondary flow duct.

15. The structural assembly in accordance with claim 13, wherein the connecting component is installed in an area of an end of the secondary flow duct into recesses in the support component and in this way directly adjoins the main flow path.

16. The structural assembly in accordance with claim 1, wherein at least one connector is provided locally on the circumference on a side of the support component facing away from the main flow path for receiving a replaceable plug.

17. The structural assembly in accordance with claim 1, wherein the replaceable plug is a multi-part element.

18. The structural assembly in accordance with claim 17, wherein the replaceable plug is split along at least part-sections of the secondary flow duct into part-plugs.

19. A fluid-flow machine having a structural assembly in accordance with claim 1.

20. A structural assembly for a fluid-flow machine comprising:

a main flow path boundary confining a main flow path of a fluid-flow machine, where a row of blades each with one blade end is arranged in the main flow path, where a gap exists between the blade ends of the at least one row of blades and the main flow path boundary, and where there is a rotating relative movement between the blades of the row of blades and the main flow path boundary, a secondary flow duct, having in the main flow path boundary two openings, one opening each at ends spaced apart in a flow direction, such that the secondary flow duct is connected to the main flow path via the two openings, a support component, a replaceable plug connected directly or indirectly to the support component, wherein the replaceable plug includes a part-section of the secondary flow duct, where the part-section complements at least one further part-section of the secondary flow duct extending outside the replaceable plug in the structural assembly such that the secondary flow duct is continuous between the two openings, wherein the assembly furthermore includes an insertion component, and the support component includes a recess extending in the circumferential direction and receiving along the circumference the insertion component, and where faces of the insertion component form part of the main flow path boundary and a part-section of the secondary flow duct, wherein the replaceable plug passes through both the support component and the insertion component.

21. A structural assembly for a fluid-flow machine comprising:

a main flow path boundary confining a main flow path of a fluid-flow machine, where a row of blades each with one blade end is arranged in the main flow path, where a gap exists between the blade ends of the at least one row of blades and the main flow path boundary, and where there is a rotating relative movement between the blades of the row of blades and the main flow path boundary, a secondary flow duct, having in the main flow path boundary two openings, one opening each at ends spaced apart in a flow direction, such that the secondary flow duct is connected to the main flow path via the two openings, a support component, a replaceable plug connected directly or indirectly to the support component, wherein the replaceable plug includes a part-section of the secondary flow duct, where the part-section complements at least one further part-section of the secondary flow duct extending outside the replaceable plug in the structural assembly such that the secondary flow duct is continuous between the two openings, wherein the replaceable plug is a multi-part element.

22. The structural assembly in accordance with claim 21, wherein the replaceable plug is split along at least part-sections of the secondary flow duct into part-plugs.

* * * * *